United States Patent [19]

Martin

[11] Patent Number: 4,545,780

[45] Date of Patent: Oct. 8, 1985

[54] APPARATUS AND METHOD OF MAKING CARTONS

[76] Inventor: William E. Martin, 6378 N. McKinley, Flushing, Mich. 48333

[21] Appl. No.: 456,550

[22] Filed: Jan. 10, 1983

Related U.S. Application Data

[63] Continuation-in-part of Ser. No. 377,345, May 12, 1982, abandoned.

[51] Int. Cl.[4] ..... B31B 1/10; B31B 1/88

[52] U.S. Cl. ..... 493/11; 493/29; 493/55; 493/74; 493/325; 493/464; 83/236

[58] Field of Search ..... 493/29, 11, 62, 61, 493/74, 73, 55, 325, 324, 464; 83/236, 336

[56] References Cited

U.S. PATENT DOCUMENTS

| | | | |
|---|---|---|---|
| Re. 13,807 | 10/1914 | Inman | 493/55 |
| 2,657,044 | 10/1953 | Apgar | 493/399 X |
| 3,336,846 | 8/1967 | Berghgracht | 493/62 X |
| 3,454,447 | 7/1969 | Corbett et al. | 493/11 X |
| 3,599,521 | 8/1971 | Lee | 83/236 X |
| 3,796,117 | 3/1974 | Mukai et al. | 83/236 X |
| 3,991,663 | 11/1976 | Glasby | 493/11 |
| 4,070,951 | 1/1978 | Bala | 493/29 X |

FOREIGN PATENT DOCUMENTS

| | | | |
|---|---|---|---|
| 1022157 | 3/1966 | United Kingdom | 83/236 |

*Primary Examiner*—James F. Coan

*Attorney, Agent, or Firm*—Fisher, Crampton, Groh & McGuire

[57] ABSTRACT

Apparatus making foldable box blanks of pre-printed corrugated material by continuously delivering pre-printed web material to a reciprocating press which is operated intermittently to cut and score the web material and utilizing an accumulator mechanism which receives the pre-printed web material continuously and delivers it intermittently.

18 Claims, 12 Drawing Figures

Fig-9
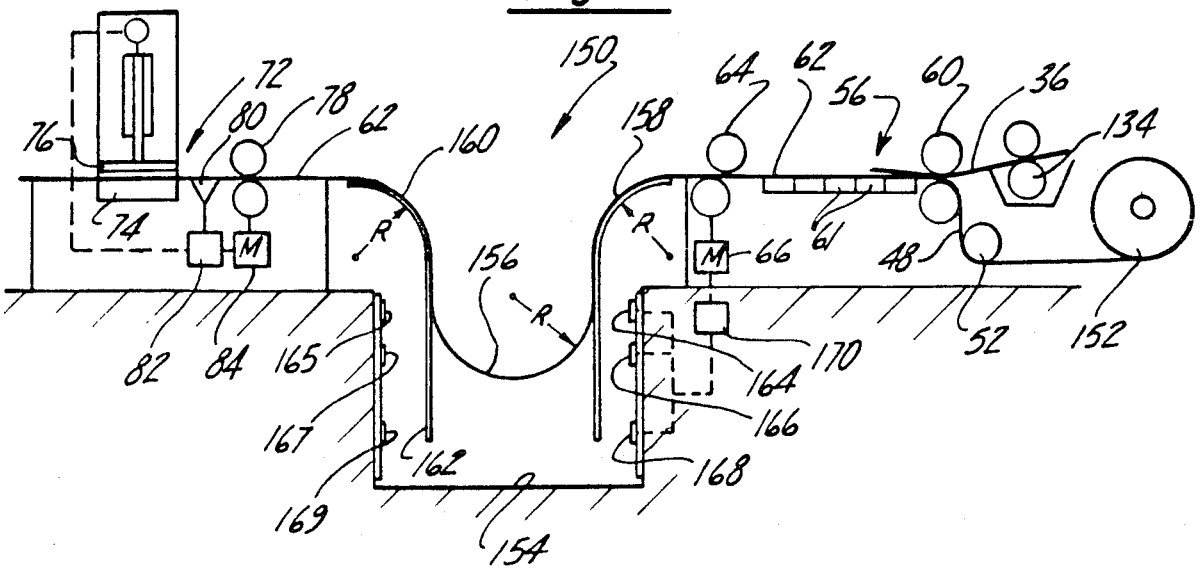
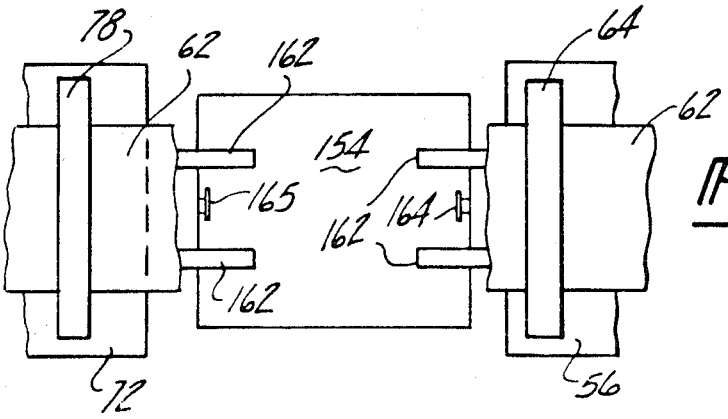
Fig-10
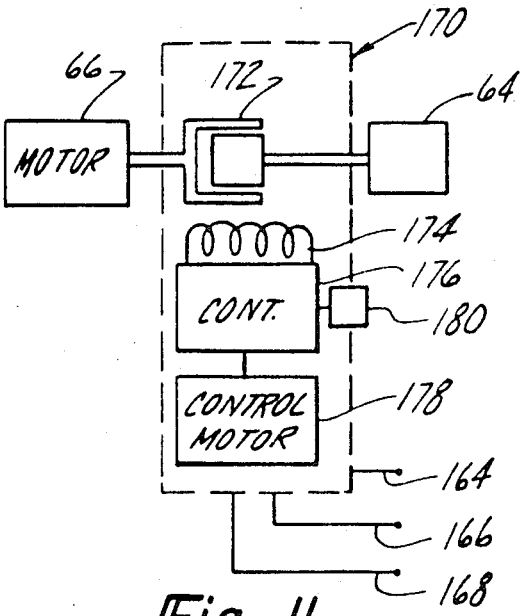
Fig-11
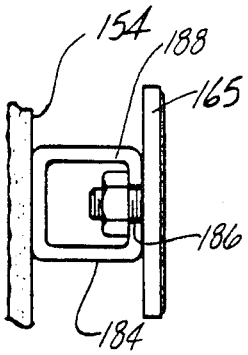
Fig-12

APPARATUS AND METHOD OF MAKING CARTONS

This a continuation-in-part application of prior application Ser. No. 377,345 filed May 12, 1982 now abandoned.

This invention relates to the apparatus and method of making double-faced, corrugated boxes with printing thereon and more particularly, for making such boxes in a continuous process.

Heretofore, boxes formed of corrugated material with flat sheets at opposite sides of a corrugated coil were made by severing the three-layered material into individual boards and subsequently printing, cutting and scoring in multiple stages of operations. The corrugated material presents problems in attempting to use continuous processes because of the rigidity of the material which prevents sufficient flexibility for rotary operations.

It is an object of the invention to provide a method and apparatus for forming a printed, corrugated box from a continuous web of double-faced corrugated material, one face of which is printed.

It is another object of the invention to provide apparatus for forming printed corrugated boxes in which the web material is delivered continuously to a reciprocating press at which the web material is cut and scored.

Still another object of the invention is to provide an accumulator arrangement in which web material is supported in a manner receiving the material continuously and delivering it intermittently.

It is an object of the invention to provide a method and apparatus of forming printed corrugated boxes continuously in which means are provided to add flexibility to a web of corrugated material making it possible to use equipment for handling flexible webs.

The objects of the invention are accomplished by apparatus in which a web of paper material is printed with various indicia and messages including a printed reference mark and wherein another web of single-backed corrugated paper web is formed. The printed web and the single-backed web are joined together to form a double-backed continuous web of printed corrugated web material. The double-backed printed material is delivered continuously from a first station to an accumulator and from the accumulator the material is delivered at an intermittent rate to a reciprocating press in which the web material is cut and scored to form a box blank. Between the first and second station is an accumulator which suspends the web material with the length of web between the first and second stations varying between a maximum and a minimum. Control means are provided for regulating the speed of delivery from the first station so that the speed varies between a maximum and a minimum. Such speed is varied under the influence of control means which respond to the maximum length of material in the accumulator to cause delivery at a minimum rate and respond to a miminum length of material in the accumulator to deliver the web at a maximum rate. Means also are provided to make even thick corrugated material which normally is very stiff and substantially inflexible, adapted for use in an accumulator which requires longitudinally flexible materials by making spaced false scoring or lines of weakening to make the otherwise relatively stiff material sufficiently flexible for use with the accumulator.

The objects of the invention are accomplished by the embodiment disclosed in the following description and illustrated in the drawings in which:

FIG. 9 is a diagrammatic view similar to FIG. 1 but of another embodiment of the invention;

FIG. 10 is a top view of a portion of the apparatus seen in FIG. 9 with a portion of the web broken away to facilitate disclosure;

FIG. 11 is a diagrammatic view of a control system used in regulating the apparatus shown in FIG. 9; and FIG. 12 is a cross-sectional view taken on line 12—12 in FIG. 1.

Figures 1, 2, 3, 4, 5, 6, 7, 8:
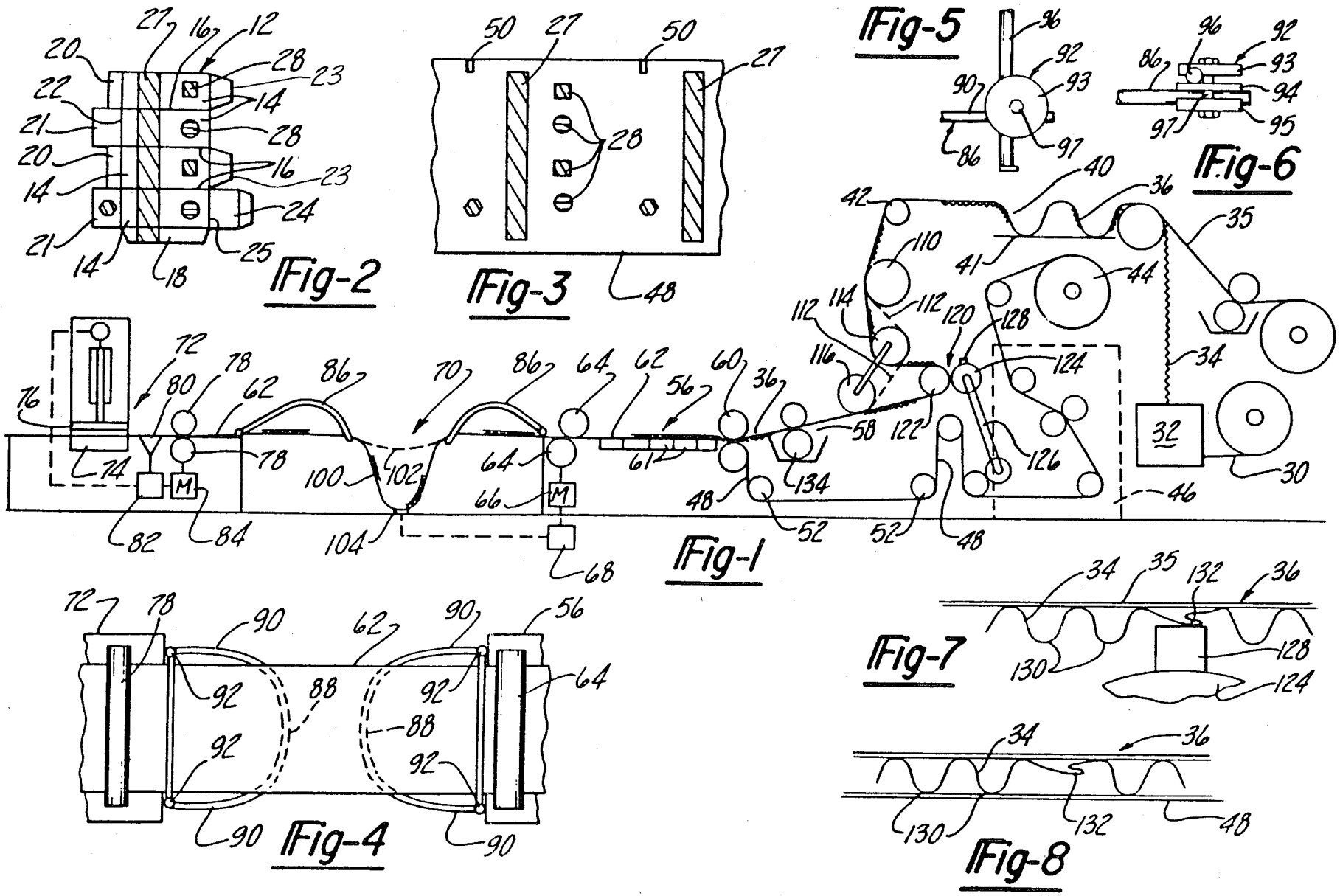
FIG. 1 is a diagrammatic view of the apparatus for continuously forming foldable box blanks of pre-printed corrugated material.
FIG. 2 illustrates an example of the type of box blank that can be formed.
FIG. 3 is a bottom view of a portion of the double-faced corrugated material after it has been printed.
FIG. 4 is a diagrammatic view of a portion of the apparatus illustrated in FIG. 1.
FIG. 5 is an enlarged top view of a portion of a clamping element shown in FIG. 4.
FIG. 6 is a side view of the clamping arrangement illustrated in FIG. 5.
FIG. 7 is a view of a section of the corrugated material as it appears in one stage of the method of forming box blanks.
FIG. 8 is a view showing a section of the corrugated material as it appears in a later stage of the blanking operation.

FIG. 1 illustrates the apparatus by which foldable carton 12, that is, blanks of pre-printed corrugated material, such as shown in FIG. 2 can be produced for subsequent assembly. Such cartons 12 can take a variety of shapes but by way of example, can have four sides 14 foldable along longitudinally extending score or crease lines 16. The sides 14 are foldable along the score lines 16 and a tab 18 attached to one of the sides may be glued to the side at the opposite edge of the blank 12. Similarly, bottom tabs 20 and 21 can be folded along transversely extending score line 22 and glued to form the bottom of the carton. Side flaps 23 and box cover 24 can be folded along score line 25 to close the top of the box. The box blank 12 can be pre-printed in one or more colors at locations shown for example by the markings 27 and 28.

The carton 12 is made of double-faced corrugated paper formed in the initial stages of the carton forming apparatus 10. As seen in FIG. 1, a paper web 30 is delivered to a corrugating machine 32 and results in a corrugated web 34 which is bonded to a web 35 to form a single-faced web 36. The web 36 has corrugations which extend generally transversely making the web 36 relatively stiff in a transverse direction but permitting flexibility in a longitudinal direction. This makes it possible for the web 36 to be temporarily stored at an accumulator station indicated at 40. The accumulator station 40 can be in the form of a platform 41 permitting the web 36 to be in a slack condition for removal from the accumulator 40 on demand from a roll 42 forming a first conveyor.

Paper stock in the form of a web 44 can be delivered on demand to a printing machine 46. In the printing machine 46, the web 44 can be printed in one or more colors with various messages and designs and delivered from the machine in the form of a printed web 48 includes the printed markings 27 and 28 also seen in the carton blank 12 in FIG. 2. In addition, the web 48 is printed with registration marks 50 along the margin of the printed web 48.

The printed web 48 is delivered from the printer 46 over rolls 52 to a backing machine 56 sometimes called a double-backer. The single-faced web 36 also is delivered to the backing machine 56 after it has first passed through a gluing station 58 at which adhesive is applied to the corrugated web portion. Subsequently, the printed web 48 is joined with the single-faced web 36 at the roll station 60 and is delivered through the backing machine 56 where the joined webs are heated by electric heaters 61 and the adhesive is cured so that the single-faced web 36 and printed web 48 are joined together to form a double-backed web 62. The web 62 moves to rolls designated at 64 which form a conveyor or supply means for discharging the web 62 from the backing machine 56.

The double-backed web 62 having a corrugated core and backing at opposite sides is moved through the backing machine 56 at a speed determined by a motor 66 regulated by a control mechanism 68.

From the double-backer machine 56 the web 62 is delivered through an accumulator station 70 and through a cutting and scoring press or station 72.

The press includes a stationary die 74 and a reciprocating die 76. The reciprocating die 76 is moved up and down vertically at a uniform speed. As the web 62 enters the reciprocating press 72, the dies 74 and 76 meet to cut and score the web 62. During such cutting and scoring, the web 62 must be momentarily stopped. Nevertheless, the die 76 can be reciprocated at a relatively fast rate, for example, approximately 75 to 150 cycles per minute during which time the longitudinally and transversely extending score lines are formed and the perimeter fo the carton 12 is cut.

The web 62 must be supplied to the press 72 intermittently by supply or feed rolls 78 which must supply the web 62 in a motion synchronized to the motion of the press 72. More particularly, the web 62 must be delivered in accordance with the position of the pre-printed material 27 and 28 on the web 62. Such synchronization is accomplished by a scanner 80 disposed along one edge of the web 62 to sense the position of the registration marks 50 and signal a control system 82 which regulates a motor mechanism 84 driving the supply rolls 78 in synchronization with the reciprocation of the die 76. In this manner, the press 72 reciprocates at a constant rate and the supply rolls 78 deliver the printed double-backed web material 62 intermittently through the press 72 to insure that the cutting and scoring portions of the die 74 and 76 are appropriately aligned with the printed markings 27 and 28. If the position of the preprinted materials 27 and 28 should vary, so also will the position of the registration marks 50 and the intermittent rate of the supply rolls 78 will be similarly varied to insure that the position of the printed material is properly synchronized with the movement of the dies 74 and 76 relative to each other.

The accumulator station 70 disposed between the rolls 64 and the supply roll 78 of the press 72 must accommodate the problem of receiving the web 62 at a relative continuous rate from the rolls 64 and disposing or delivering the web 62 intermittently at the feed rolls 78. Also, both the continuous delivery rate to accumulator 70 and the intermittent disposal rate from the accumulator 70 are variable. Both sets of rolls 64 and 78 are operated simultaneously but substantially independently of each other although the rates of operation are selected to be generally similar.

The accumulator station 70 includes a pair of similar but oppositely extending flexible support members 86 in the form of bent, flexible rods made of material such as fiberglass reinforced resin, for example. Each of the support rods 86 is bent into a general U-shape with a bight portion 88 adapted to be disposed at the underside of the web 62 and a pair of legs 90 extending from the bight 88 and having their free ends fixed by brackets 92 at opposite of the path of the web movement and associated with the backing machine 56 and with the press 72.

As seen in FIGS. 5 and 6, the brackets 92 include stacked washers 93, 94 and 95 which clamp each of the legs 90 to a rod 96 transversely to the path of movement of the web 2 by means of a bolt 97. The bracket arrangements 92 make it possible to adjust the inclination of the support rods 86 relative to the transverse rods 96 so that the web 62 passing over the bight portions 88 deflects the support rods 86 and resiliently supports the web 62.

The web 62 passes from the rolls 64 and over the bight portion 88 of the rod element 86 associated with the backing machine 56 and over the bight 88 of the other rod element associated with the press 72. As shown in FIG. 1, the web 62 which is flexible due to the transversely extending corrugations, drapes between the two bight portions 88 to form a loop 100 which varies in length from a maximum indicated in the full line position in FIG. 1 to a minimum indicated in broken line at 102. In the maximum length position of the loop 100, the web 62 engages a switch mechanism 104 which sends a signal to the control mechanism 68 regulating the speed of the motor 66. Control mechanism 68 may be of a type which controls the motor 66 to operate at either a maximum speed or a minimum speed, with both of such speeds being selectable.

As the web 62 leaves the delivery rolls 64 and is draped in the maximum length position shown at 100 in FIG. 1, switch 104 is engaged to cause the motor to drive the rolls 64 at its lowest selected speed. Eventually this will cause the supply rolls 78 to transport the web 62 at a faster rate than it is being delivered by the rolls 64. This results in the web 62 moving toward the minimum length position indicated at 102 and out of engagement with the control switch 104. Such movement results in regulating the control 68 so that the motor 66 increases its speed to the selected maximum rate and the web 62 is subsequently delivered from the rolls 64 at a higher rate. Eventually, if the web 62 comes into engagement with the switch 104, speed of the delivery from backing machine 56 will be diminished. In this manner the web 62 is draped in a position varying between its maximum length at 100 and its minimum length at 102. During such movement of the web 62, the rod elements 86 act to support the web 62 and permit it to move vertically and horizontally in undulating motions which are absorbed by the rod elements 86.

In actual practice, it was found that glass rods having a diameter of about one-half of an inch were adequate to support a length of relatively heavy weight of corrugated paper stock.

After the cut and scored web 62 leaves the cutting and scoring station or press 72, the box blanks 12 can be separated from the scrap portion of the web 62 and the cut and scored blanks 12 can be stacked in unfolded condition for shipment to a point at which they can be assembled to receive the materials to be packaged.

The successful operation and synchronization of the continuously moving web with the intermittently operating press 72 relies on the longitudinal flexibility of the corrugated, double-backed material so that it can assume a draped position between the rods 86 associated with the backing machine 56 and the press 72. The required flexibility is relatively easily achieved with thinner sizes of corrugated double-backed material. However, when the corrugated web material is of a thicker dimension, the longitudinal stiffness of the material is increased so that it does not easily form a loop between the positions indicated at 100 and 102 in FIG. 1. With thinner webs of corrugated material the threading of the material between the roll 42 from the accumulator 40 the glue station indicated at 58 can be over roll 110 and as indicated in dotted lines at 112 over a pair of rolls 114 and 116 to the glue station 58. This path of movement as indicated in part by the lines 112 bypasses scoring apparatus indicated at 120. The scoring apparatus 120 includes a pair of rotating cylinders 122 and 124, the rotation of which is synchronized with the printing machine 46 by drive means 126. The cylinder 124 is provided with a bar 128 which extends the full length of the cylinder 124 and transversely to the direction of travel of the web 36. When the web 36 is of a heavier material, it is threaded between the rolls 114 and 116 over the cylinder 122 so that the web 36 passes through the nip between the rolls 122 and 124 and thereafter to the glue station 58.

As the cylinders 122 and 124 rotate in unison and in synchronization with the printing machine 46, the bar 128 engages a single corrugation and crushes it to form a crushed corrugation 132 in a predetermined fixed relationship relative to the registration marks 50 printed on the web 48 coming from the printing machine 46 and in uniformly spaced relationship as illustrated, for example, in FIG. 3.

After leaving the scoring apparatus 120, the single backed corrugated web 36 passes under roll 116 to the glue station 58. The glue station 58 includes a glue application roll 134 which applies glue to the corrugations 130 of the web 36. The adhesive, which can be in the nature of a solution of corn starch, is applied only to the tips of the corrugations 130 leaving the crushed corrugation 132 without any adhesive. Subsequently, at the roll station 60 forming the entry to the backing machine 56, the web 36 and the printed web 48 are brought into contact with each other and after passing through the backing machine 56 results in the finished double-backed web 62 which is delivered from the roll station 64. Since adhesive is not applied to the crushed corrugation 132, a line of weakening is formed which extends transversely of the web 62 as indicated in the positions at crushed corrugation 132 in FIG. 8. As a result, as the web 62 enters the accumulator station 70 and passes over the flexible rod 86, the web 62 folds due to its own weight along the resultant line of weakening so that it is free to assume the looped position between the positions indicated at 100 and 102. This permits operation of the accumulator 70 to properly synchronize the delivery of the web 62 to the reciprocating press 72.

In effect, the scoring apparatus 120 forms a false score that weakens the web 62 so that it can fold in either direction. The line of weakening is located at the edge of each box or carton blank 12. In other words, the false score lines can be spaced apart a distance equal to the dimension of a single box blank 12 and occur at the opposite edges of the portion from which the blank 12 is formed.

To convert the apparatus from an arrangement to handle relatively heavy corrugated material to one processing corrugated materials which are more flexible longitudinally, it is possible to bypass the scoring apparatus 120 by rethreading the web 36 to travel in the path indicated by broken lines 112 in FIG. 1.

Referring now to FIGS. 9 and 10, another embodiment of the invention is disclosed in which an accumulator station 150 is substituted for the accumulator 70 seen in FIG. 1. The reciprocating press 72 can be identical with that used in the prior embodiment of the invention. Similarly, the double-backer machine 56 which forms the web 62 of corrugated paper can be identical with the apparatus in FIG. 1. However, if desired, the in-line printing machine 46 can be omitted and instead the printed web 48 can be supplied from a roll 152 printed at a separate printing line. As in the prior embodiment of the invention, the web of corrugated material 62 is fed continuously from supply rolls 64 to the feed means 78 which deliver the web 62 intermittently to the press 72.

The accumulator 150 is particularly adapted to accommodate relatively heavy corrugated web material 62. For that purpose, the accumulator station 150 includes a pit 154 in which the web 62 can drop vertically below the level of the supply rolls 64 and feed rolls 78 to form a loop 156. Heavy corrugated web material 62 can be bent longitudinally without forming a transverse fold provided that the radius of the bend is relatively large. To accommodate such webs, the bend 158 leaving the supply rolls 64 should have a radius exceeding the safe radius. Similarly, the radius of the bend 160 prior to the web 62 entering the feed rolls 78 should have a similar radius. Additionally, the radius of the loop 156 should exceed the minimum radius. From this it will be seen that the spacing between the backing machine 56 and the reciprocating press 72 must be no less than four times the minimum radius avoiding folding of the web 62.

To guide the web 62 as it leaves the backing machine 56 and enters the press 72, the path of movement of the web 62 is provided with a pair of flexible track members 162. The track members 162 are arranged in pairs with one end of each track member 162 fastened to the associated backing machine 56 or press 72 and with the opposite ends left free to hang in the pit 154. The track members 162 are made of polished steel and are sufficiently rigid so that the combined weight of the track members 162 and the web material 62 sliding over the track members does not exceed the safe bending radius of the web material 62.

As in the prior embodiment of the invention, the length of the web 62 between the supply rolls 64 and the feed roll 68 accommodates change from continuous to intermittent motion and also permits the web 62 to form a loop 156 varying in length between a maximum and a minimum to accommodate overall speed variances between the web forming or backing machine 56 and the reciprocating press 72.

The speed of the motor 66 determines the delivery rate of the web material 62 from the supply rolls 64. For this purpose, the vertical height of the loop 156 in the recess or pit 154 is sensed by photoelectric cells 164, 166 and 168 and corresponding reflectors 165, 167 and 169. The photoelectric cells and the reflectors are so arranged that they are in alignment with each other longitudinally of the web 62 with the paths of the beams between the photoelectric cells 164, 166 and 168, and the reflectors 165, 167 and 169, passing between the pairs of track members 162. The photoelectric cells and reflectors are arranged to signal a control system indicated at 170 with the cell 164 and reflector 165 determining minimum length of web material 62 or the maximum vertical height of the loop 156 at the accumulator station 150. The photoelectric cell 166 and reflector 167 are employed to determine the lowest operating position of the loop 156 and, therefore, the maximum length of web material 62. The lowest photoelectric cell 168 and its corresponding reflector 169 are employed to completely close down the carton making machine.

The control system 170 includes an eddy current clutch 172 interposed between the motor 66 and the supply roll 64.

The torque transmitted by the motor 66 to the web forming or double-backing machine 56 is determined by the clutch field 174 which is excited by direct current from the controller 176. The controller 176 is in the form of a rotatable rheostat driven by a small reversible control motor 178 responding to signals from the photoelectric cells 164, 166 and 168. The control motor is driven to either increase or decrease the direct current delivered to the clutch field 174 thereby varying the transmitted torque from the motor 66 to the machine 56. The speed at which the control motor 178 makes changes can be controlled by a speed control device indicated at 180.

In operation, the speed of the reciprocating press 72 is established at some desirable rate and the speed of the web forming machine 56 is synchronized with the speed of the press 72 by means of the accumulator station 150. With the path of the photoelectric cells 164 and 166 interrupted by the web 62, and with the path of the photoelectric cell 168 uninterrupted, the web 62 will be at its maximum length and the motor 66 will have been signalled to decrease its speed. The decrease in speed continues until the loop 156 begins to rise vertically thereby shortening the length of web in accumulator 150. Ultimately, the path of the photocells 164 and 166 will be uninterrupted at which time the motor 66 will be signalled to increase its feed. This causes the loop 156 to move downwardly to increase the length of the web 62 within the accumulator station 150.

Both the maximum and the minimum speed of the motor 66 can be selected so that subsequent control by way of the photoelectric cells causes the supply roll 64 to deliver the web 62 between the selected minimum and maximum. If for some reason the maximum speed is not low enough to feed the web 62 to the accumulator station 150, as might occur if the press 72 slows down or stops, the path of the lowest photoelectric cell 168 will be interrupted by the loop 156, in which case the control becomes effective to stop the entire machine.

Further adjustment and flexibility of the accumulator 150 is afforded by the mounting of the photoelectric cells 164, 166 and 168 as well as the mounting of the corresponding reflectors 165, 167 and 169. For this purpose, opposed vertical end walls of the pit 154 are each provided with channel-shaped posts 184. The photoelectric cells and the reflectors are each provided with a stud 186 having a nut threaded thereon 188 which locks against the flanges of the post 184 when the stud and photoelectric cell or reflector are tightened relative to each other. This makes it possible to vary the vertical spacing to further vary the time interval between speed changes of the motor 66.

The method and apparatus for forming web material and particularly corrugated double-backed material into foldable box blanks has been provided in which single-backed corrugated web material and a pre-printed web of material are joined together to form a double-backed, printed corrugated web from which foldable box blanks are cut and scored by a reciprocating press. The press receives the web of material intermittently from an accumulator mechanism which receives the double-backed corrugated material. The accumulator receives material continuously at a rate varying between a maximum and a minimum and delivers it to the press at an intermittent rate which causes the web material in the accumulator to vary between a maximum and a minimum. Means are provided responding to the variable length of the web material passing through the accumulator so that when the web material therein is at a maximum length, the delivery of web material to the accumulator is reduced to a minimum and when the length of material is at a miminum, the rate of delivery is increased, thereby making it possible to form foldable, pre-printed box blanks of corrugated material by employing a reciprocating press. The accumulator relies on the longitudinal flexibility of the web of corrugated material and such flexibility is enhanced in heavier grades of corrugated stock by an apparatus which form lines of weakening permitting transverse folding of the web at uniformly spaced locations. In another embodiment of the invention, the corrugated material is allowed to bend in the accumulator over radii which are sufficiently large to prevent folding or creasing.

The embodiments of the invention in which an exclusive property or privilege is claimed are defined as follows:

1. The method of making pre-printed cartons comprising the steps of: forming a continuous single-backed corrugated paper web, including forming uniformly spaced corrugations extending transversely of the direction of web travel and crushing single corrugations at uniformly spaced intervals along said web to form lines of weakening, printing a continuous web of paper material with printed reference marks, joining said corrugated paper web and said continuous web of material to form a continuous double-back printed paper web, conveying said printed paper web from a first station to a second station, supporting said web in a slack condition between said first and second station while said web varies between a maximum and a minimum length, passing said web from said second station relative to a sensing means sensing the position of said reference marks, delivering said web to a press reciprocating at a uniform rate in timed relationship to the spacing of said reference marks, and varying the speed of said web delivered to said first station in accordance with the length of said web between said first and second stations, adding adhesive to all corrugations of said single-backed corrugated paper web except said single corrugations prior to joining said continuous web and said single-backed corrugated web.

2. The method of making pre-printed cartons set forth in claim 1 wherein said single corrugations are disposed in predetermined relationship to said reference marks.

3. Apparatus for forming web material into foldable box blanks comprising: supply means forming a pre-printed web, a reciprocating press including dies engagable with said web to cut and score blanks for forming boxes, said press reciprocating continously at a substantially uniform rate, feed means continuously delivering said web intermittently to said press in timed relationship to the reciprocation of said press, an accumulator mechanism interposed between said supply means and said feed means to hold a length of web and intermittently deliver it to said feed means, power means for said supply means to vary the rate of deliver of said web from said supply means between a minimum and a maximum rate and a minimum rate to vary the length of web material in said accumulator mechanism between a maximum length and a minimum length, and control means responsive to a minimum length of said web in said accumulator mechanism to increase the speed of said power means and responsive to a maximum length of said web in said accumulator mechanism to decrease the speed of said power means, said control means being engageable with said web when the length of web in said accumulator mechanism is at a maximum and movable out of engagement with said web when said accumulator mechanism is at a minimum, said accumulator mechanism including resilient means supporting said web.

4. The apparatus of claim 3 wherein said resilient means includes flexible members engaging the underside of said web and suspending it in elevated position above said control means.

5. The apparatus of claim 4 wherein said resilient means are elongated flexible members having a generally U-shaped configuration with the free ends supported at opposite sides of said web and the bight portion engaging the underside of said web.

6. The apparatus of claim 5 wherein said flexible rod is made of fiberglass reinforced resin.

7. Apparatus for making printed corrugated boxes comprising: means for making a corrugated web of single-backed paper, means for printing a continuous web of material with uniformly spaced areas of printing, means bonding said single-backed web and printed web together to form a corrugated continuous printed web, a conveyor for transporting said corrugated continuous web continuously and at a speed varying between minimum and a maximum, a reciprocating press including dies engageable with said web to cut and score a blank for forming a box, said press being reciprocated continuously at a substantially uniform rate, supply means operable to deliver said web to said press, means for sensing said areas of printed material on said web for regulating the speed of said supply means in timed sequence with said press, accumulator means between said conveyor and said supply means for receiving and storing a variable length of said continuous printed web in a draped condition between said conveyor and said supply means, and means sensing the length of web in said accumulator means and operative to control the rate of delivery of said web from said conveyor to said accumulator means.

8. The apparatus of claim 7 wherein the web received in said accumulator means varies between a maximum and a minimum length, control means responsive to the maximum length of said web to decrease the speed of said conveyor and responsive to a minimum length of said web to increase the speed of said conveyor.

9. The apparatus of claim 8 wherein said control means is engageable with said web when the length of web in said accumulator means is at a maximum and is movable out of engagement with said web when the length within said accumulator means is at a minimum.

10. The apparatus of claim 7 and further comprising scoring means operative on said single-backed web to form a transverse line of weakening for permitting folding of said double-backed web at said accumulator means.

11. The apparatus of claim 10 wherein said scoring means includes a means for crushing a single corrugation of said single-backed web at a predetermined spacing relative to each of said areas of printing.

12. The apparatus of claim 11 wherein said means bonding is operative to apply adhesive to all corrugations of said single-backed web except said single corrugations to form said lines of weakening.

13. The apparatus of claim 7 wherein said supply and conveyor are spaced from each other and wherein said web between said supply and conveyor is longer than said spacing between said supply and conveyor to form a vertically extending loop, said control means including sensing means responsive to the minimum and maximum vertical height of said loop to respectively increase and decrease the speed of said power means.

14. The apparatus of claim 13 wherein said web received from said conveyor is bendable longitudinally over a predetermined maximum radius without folding and wherein the spacing between said supply and conveyor is no less than four times said predetermined radius of said web.

15. The apparatus of claim 14 and further comprising a space formed below the level of said supply and conveyor to receive said loop.

16. The apparatus of claim 13 wherein said sensing means comprise photoelectric cells.

17. The apparatus of claim 16 wherein separate photoelectric cells sense the maximum and minimum vertical height of said loop formed in said web.

18. Apparatus for forming web material into foldable box blanks comprising: supply means forming a preprinted web, a reciprocating press including dies engageable with said web to cut and score blanks for forming boxes, said press reciprocating continuously at a substantially uniform rate, feed means continuously delivering said web intermittently to said press in timed relationship to the reciprocation of said press; an accumulator mechanism interposed between said supply means and said feed means to hold a length of web and intermittently deliver it to said feed means, power means for said supply means to vary the rate of deliver of said web from said supply means between a maximum rate and a minimum rate to vary the length of web material in said accumulator mechanism between a maximum length and a minimum length, and control means responsive to a minimum length of said web in said accumulator mechanism to increase the speed of said power means and responsive to a maximum length of said web in said accumulator mechanism to decrease the speed of said power means, said control means including a control motor for selecting the rate at which the speed of said power means is changed.

* * * * *

REEXAMINATION CERTIFICATE (1180th)

United States Patent [19]

Martin

[11] B1 4,545,780

[45] Certificate Issued Jan. 2, 1990

[54] APPARATUS AND METHOD OF MAKING CARTONS

[76] Inventor: William E. Martin, 6378 N. McKinley, Flushing, Mich. 48333

Reexamination Request:
No. 90/001,693, Jan. 23, 1989

Reexamination Certificate for:

| | |
|---|---|
| Patent No.: | **4,545,780** |
| Issued: | **Oct. 8, 1985** |
| Appl. No.: | **456,550** |
| Filed: | **Jan. 10, 1983** |

Related U.S. Application Data

[63] Continuation-in-part of Ser. No. 377,345, May 12, 1982, abandoned.

[51] Int. Cl.[4] ..... B31B 1/10; B31B 1/88

[52] U.S. Cl. ..... 493/11; 493/29; 493/55; 493/74; 493/325; 493/464; 83/236

[58] Field of Search ..... 493/11, 29, 61–62, 493/73–74, 324–325, 464, 55; 83/236, 336; 226/114, 115

[56] References Cited

U.S. PATENT DOCUMENTS

| | | | |
|---|---|---|---|
| Re. 13,807 | 10/1914 | Inman | 493/55 |
| 2,616,689 | 11/1952 | Baumgartner | 271/2.4 |
| 2,657,044 | 10/1953 | Apgar | 493/399 X |
| 2,907,565 | 10/1959 | Sauter | 271/2.2 |
| 3,107,836 | 10/1963 | Veld | 226/196 |
| 3,177,749 | 4/1965 | Best | 83/208 |
| 3,240,411 | 3/1966 | Zarleng | 226/42 |
| 3,336,846 | 8/1967 | Berghgracht | 493/62 X |
| 3,454,447 | 7/1969 | Corbett et al. | 493/11 X |
| 3,489,043 | 1/1970 | Dent | 83/9 |
| 3,575,331 | 4/1971 | Middleman | 226/199 |
| 3,599,521 | 8/1971 | Lee | 83/236 X |
| 3,796,117 | 3/1974 | Mukai et al. | 83/236 X |
| 3,807,612 | 4/1974 | Eggert | 226/42 |
| 3,973,493 | 8/1976 | Black | 110/176 |
| 3,991,663 | 11/1976 | Glasby | 493/11 |
| 4,070,951 | 1/1978 | Bala | 493/29 X |

FOREIGN PATENT DOCUMENTS

| | | | |
|---|---|---|---|
| 1022157 | 3/1966 | United Kingdom | 83/236 |

OTHER PUBLICATIONS

"Report containing Opinions of Court-Appointed Expert Grauer", 10/2/84, Webcor v. Paper Group, 83CV8178 USDC(ED Mich-Flint).

"Evaluation of Plaintiff's Trade Secret Claims", E. F. Cornelius, 11/25/83, Webcor v. Paper Group, 83CV8178, USDC(Ed Mich-Flint).

"Paper Board Industry", International Paper Board Industry, vol. 24, No. 8, Aug. 1981, pp. 3, 13, 14, 16 and 17.

"Printed and Die-Cut Blanks-Direct from the Corrugater", Boxboard Containers, Nov. 1975, p. 24.

"Pre-printing by Offset and Laminating Inline Provides Self-sell Graphics for Corrugated", Paperboard Packaging, 4/77, p. 36.

Roger Kane's Proposal to Wells Badger Industries of May 12, 1972.

*Primary Examiner*—William E. Terrell
*Attorney, Agent, or Firm*—Irvin L. Groh

[57] ABSTRACT

Apparatus making foldable box blanks of pre-printed corrugated material by continuously delivering pre-printed web material to a reciprocating press which is operated intermittently to cut and score the web material and utilizing an accumulator mechanism which receives the pre-printed web material continuously and delivers it intermittently.

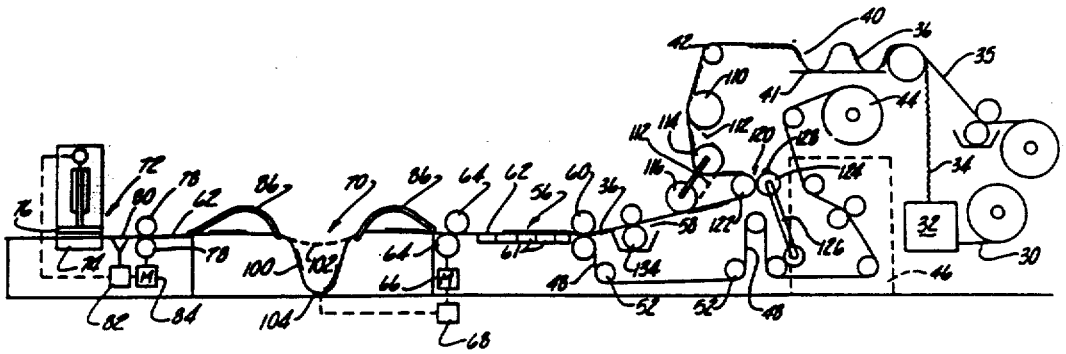

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–18 is confirmed.

* * * * *